US011015331B1

(12) United States Patent
Kang

(10) Patent No.: US 11,015,331 B1
(45) Date of Patent: May 25, 2021

(54) DRAINAGE GRATING STRUCTURE

(71) Applicant: Seungho Kang, Barrigada, GU (US)

(72) Inventor: Seungho Kang, Barrigada, GU (US)

( * ) Notice: Subject to any disclaimer, the term of this patent is extended or adjusted under 35 U.S.C. 154(b) by 0 days.

(21) Appl. No.: 17/104,363

(22) Filed: Nov. 25, 2020

(30) Foreign Application Priority Data

May 25, 2020 (KR) ..... 10-2020-0062132

(51) Int. Cl.
*E03F 5/04* (2006.01)
*E03F 5/06* (2006.01)

(52) U.S. Cl.
CPC ..... *E03F 5/04* (2013.01); *E03F 5/06* (2013.01); *E03F 2005/061* (2013.01)

(58) Field of Classification Search
CPC ... E03F 5/04; E03F 5/0404; E03F 5/06; E03F 5/14; E03F 5/125; E03F 2005/061; C02F 2103/001; B01D 2029/033; B01D 29/445; B01D 33/0166; B01D 33/0361
See application file for complete search history.

(56) References Cited

U.S. PATENT DOCUMENTS 3,527,148 A * 9/1970 Schack ..... E03F 5/06 404/25
6,478,954 B1 * 11/2002 Turner, Jr. ..... B01D 35/02 210/162
2008/0226390 A1 * 9/2008 Nino ..... E03F 5/0404 404/5

FOREIGN PATENT DOCUMENTS

| | | |
|---|---|---|
| KR | 200195768 | 9/2000 |
| KR | 101030522 | 4/2011 |
| KR | 1020180138041 | 12/2018 |
| KR | 10-1989591 | * 6/2019 |
| KR | 102058438 | 12/2019 |

OTHER PUBLICATIONS

Ryu (KR-10-1989591) original and machine translation attached (Year: 2019).*

* cited by examiner

*Primary Examiner* — Liam Royce
(74) *Attorney, Agent, or Firm* — Fish & Richardson P.C.

(57) ABSTRACT

A drainage grating includes a grating disposed on a drain, a moving panel disposed at an upper portion of the grating and configured to discharge water to the drain based on moving up and down according to a hydraulic pressure of water. The moving panel is configured to block introduction of foreign substances into the drain and facilitate cleaning or management of the drainage grating. The drainage grating is configured to be at least partially removed from a support installed at the drain to provide a sufficient drainage space in a rainy season or in heavy rain.

20 Claims, 10 Drawing Sheets

DRAINAGE GRATING STRUCTURE

CROSS-REFERENCE TO RELATED APPLICATIONS

This application claims priority to Korean Patent Application Serial No. 10-2020-0062132, filed on May 25, 2020, the contents of which are incorporated herein by reference in their entirety.

TECHNICAL FIELD

The present disclosure relates to a drainage grating structure, and more particularly, to a drainage grating structure including a moving panel.

BACKGROUND

A drainage channel may be provided at a road, or parking lots, buildings, factories, and the like. In some cases, a grating may be installed in a drain on an upper portion of the drainage channel to allow sewage, wastewater, rainwater, and the like to be introduced into the drain. The grating may be used as a drain lid to ensure safe walking of pedestrians and to smoothly perform a sewage treatment on various sewage, wastewater, and rainwater without disrupting a flow of traffic. The grating may be made of a material with strength so that the grating may sufficiently withstand a large load such as a vehicle.

In some cases, a grating may be provided in various shapes in consideration of an installation place. For example, the grating may be applied in various ways, and include a small grating installed on a rainwater collecting channel provided at a side gutter of the road and a large grating installed in a ventilation duct of the subway.

In some cases, the grating may have a rectangular or square shape according to a shape of a manhole. For instance, the grating may include a plurality of bearing bars and crossbars that maintain predetermined distances in transverse and longitudinal directions and that are coupled and welded to each other in a lattice shape in an inner surface of the grating. The bearing bars and the crossbars may be rigidly welded to each other while maintaining the same height and width with respect to a pair of first and second plates of rectangular frame bodies.

For instance, as shown in FIG. 9, a grating may include a plurality of bearing bars 11 disposed in a rectangular frame body including pairs of first plates 13 and second plates 14 to maintain the same height and width, and welded to each other. In some cases, depending on a shape of a drain conduit, the first plate 13 and the second plate 14 may have the same length. In some case, one of the first plate 13 and the second plate 14 may be longer than the other one. The bearing bars 11 may have a plate shape, and side sections of the bearing bars 11 may have a constant thickness. In addition, fastening grooves 15 may be defined in a top surface of each of the bearing bars 11 at equidistant intervals. A plurality of crossbars 12 are welded to the bearing bars 11 such that the crossbars 12 are perpendicular to the bearing bars 11, so that a torsion phenomenon caused by a load from the top may be suppressed.

The crossbar 12 may have a shape that an outer peripheral surface of a rectangular rod is twisted by torsion. The crossbar 12 is inserted into the fastening groove 15 formed in the top surface of the bearing bar 11, and has both ends welded to the pair of second plates 14. In addition, a contact portion may be welded to prevent the crossbar 12 from fluctuating with respect to the bearing bar 11. A grating 10 having such a lattice structure may ensure a walking space that maintains a contact surface with an outside on an upper side of the grating 10, and sewage, wastewater, rainwater, and the like may easily escape through a space between the bearing bar 11 and the crossbar 12.

In some cases, garbage, cigarette butts, or the like discarded by pedestrians or drivers of vehicles may pass through the space between the bearing bar 11 and the crossbar 12 so as to be introduced into the drain, and may be discharged to the river. In addition, soil of the road may be introduced into the drain through the space between the bearing bar 11 and the crossbar 12 and accumulate over time, and a smooth flow of rainwater may be obstructed.

SUMMARY

The present disclosure describes a drainage grating structure including a moving panel disposed on an upper portion of a grating and configured to perform drainage as the moving panel moves up and down according to a hydraulic pressure of rainwater only in case of rain. In addition, foreign substances may be prevented from being introduced into a drain when the moving panel is moved up, which helps cleaning or management of the grating structure. The grating can be seated in the support and easily removed to ensure a sufficient drainage space in a rainy season or in case of localized heavy rain.

The objects to be achieved are not limited to the above objects, and other objects that are not described above may be clearly understood by those skilled in the art from the following description.

According to one aspect of the subject matter described in this application, a drainage grating is configured to be installed on a drain and includes a frame configured to be disposed at a rim of the drain, the frame having a first surface, a second surface facing the first surface, a third surface connected to the second surface, and a fourth surface facing the third surface. The drainage grating further includes a plurality of vertical panels that are arranged inside the frame and partition an inside of the frame into a plurality of partition spaces, where each vertical panel has a first end connected to the first surface of the frame and a second end connected to the second surface of the frame, and a plurality of lower support bars that are disposed at a lower portion of the frame and extend in a direction across the plurality of vertical panels, where each lower support bar has a first end connected to the third surface of the frame and a second end connected to the fourth surface of the frame. The drainage grating further includes an upper support bar that is disposed at an upper portion of the frame and extends perpendicular to the plurality of vertical panels, and a plurality of moving panels that are disposed at upper portions of the plurality of partition spaces, respectively, where each moving panel is configured to, based on water pressure applied thereon, move within one of the plurality of partition spaces relative to the plurality of vertical panels.

Implementations according to this aspect can include one or more of the following features. For example, the drainage grating further includes a plurality of guide pins configured to move up and down relative to the lower support bars, where each guide pin having a fixed end coupled to one of the moving panels, and a free end configured to move up and down through one of the lower support bars, and a plurality of springs disposed at the plurality of guide pins, respectively, where each spring is configured to supply elastic force to one of the moving panels and one of the lower support bars.

In some implementations, the plurality of vertical panels can include a panel drainage hole, where each of the moving panels is configured to, based on an increase of the water pressure applied to a moving panel among the plurality of moving panels, move downward relative to the vertical panels such that water is drained through the panel drainage hole, and based on a decrease of the water pressure applied to the moving panel, move upward by the elastic force of one of the springs disposed at the moving panel.

In some examples, the lower support bars define a through-hole configured to receive one of the plurality of guide pins. In some examples, each of the lower support bars defines a plurality of through-holes, where each through-hole is configured to receive one of the plurality of guide pins based on the one of the plurality of guide pins moving downward.

In some implementations, each of the moving panels includes a base that defines a rim of one of the moving panels, where the base has a bottom surface that defines a fixing hole screw-coupled with one of the guide pins, and a plurality of protruding surfaces that protrude from a top surface of the base and that are spaced apart from one another. In some examples, the plurality of protruding surfaces can define a seating groove between adjacent protruding surfaces of the plurality of protruding surface, the seating groove supporting the upper support bar. In some examples, the base defines a drainage groove at the rim of the one of the moving panels.

In some implementations, the drainage grating is configured to be installed at a support that is disposed in the drain and that has side surfaces defining a pair of guide grooves, respectively. The frame can include a pair of fitting protrusions that protrude outward relative to the first surface of the frame and the second surface of the frame, respectively, where each fitting protrusion is configured to be inserted into one of the pair of guide grooves.

In some examples, each of the guide grooves includes a fitting groove that extends downward from an upper surface of the support, and a movement groove that extends laterally from a lower end of the fitting groove toward the third surface or the fourth surface. In some examples, the drainage grating is configured to rotate and translate relative to the support based on each of the fitting protrusions being inserted into and moving along the fitting groove and the movement groove.

In some implementations, each of the moving panels defines a seating groove recessed from an upper surface of the moving panels and configured to support the upper support bar. In some implementations, the panel drainage hole is in communication with the plurality of partition spaces.

In some implementations, each of the plurality of panels is configured to move between a first position in contact with the upper support bar and a second position vertically below the first position, where the second position varies based on the water pressure applied to one of the plurality of moving panels.

In some implementations, one or more of the plurality of vertical panels define a plurality of panel drainage holes spaced apart from one another along one of the plurality of vertical panels. In some examples, the frame defines a plurality of frame drainage holes at the third surface of the frame and the fourth surface of the frame, and each of the plurality of frame drainage holes faces one of the plurality of panel drainage holes.

In some implementations, the plurality of vertical panels include a pair of outer vertical panels that face the third surface of the frame and the fourth surface of the frame, respective, where each outer vertical plane defines a plurality of panel drainage holes, and a plurality of inner vertical panels disposed between the pair of outer vertical panels. The frame can include a plurality of frame drainage holes at the third surface of the frame and the fourth surface of the frame, and each of the plurality of frame drainage holes can face one of the plurality of panel drainage holes.

According to another aspect, a drainage grating is configured to be installed at a drain, and includes a frame configured to be disposed at a rim of the drain, the frame having a first surface, a second surface facing the first surface, a third surface connected to the second surface, and a fourth surface facing the third surface. The drainage grating includes a vertical panel that is disposed inside the frame and extends from the first surface of the frame to the second surface of the frame, where the vertical panel partitions an inside of the frame into a plurality of partition spaces, a lower support bar that is disposed at a lower portion of the frame and extends across the vertical panel from the third surface of the frame to the fourth surface of the frame, an upper support bar disposed at an upper portion of the frame and disposed perpendicular to the vertical panel, and a moving panel disposed in at least one of the plurality of partition spaces and disposed between the upper support bar and the lower support bar. The moving panel is configured to move between the upper support bar and the lower support bar based on water pressure applied to the moving panel.

Implementations according to this aspect can include one or more of the following features or the features described above. For example, the drainage grating can include a guide pin that extends from a bottom surface of the moving panel to the lower support bar, where the guide pin has an upper end coupled to the bottom surface of the moving panel, and a lower end configured to pass through the lower support bar. The drainage grating can include a spring that surrounds the guide pin and is configured to apply elastic force to the bottom surface of the moving panel and the lower support bar.

In some implementations, at least one of the vertical panel, the third surface of the frame, or the fourth surface of the frame defines a drainage hole that is configured to discharge water to the drain based on movement of the moving panel toward the lower support bar.

DETAILED DESCRIPTION

Hereinafter, one or more implementations will be described in detail.

Figure 1:
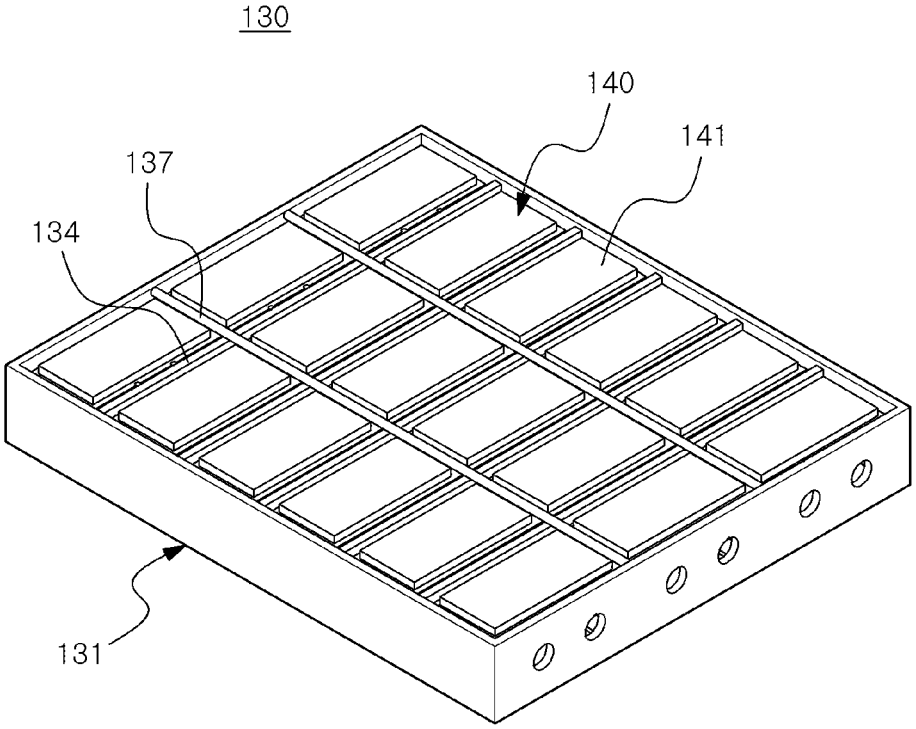
FIG. 1 is a perspective view showing an example of a grating.
Figure 2:
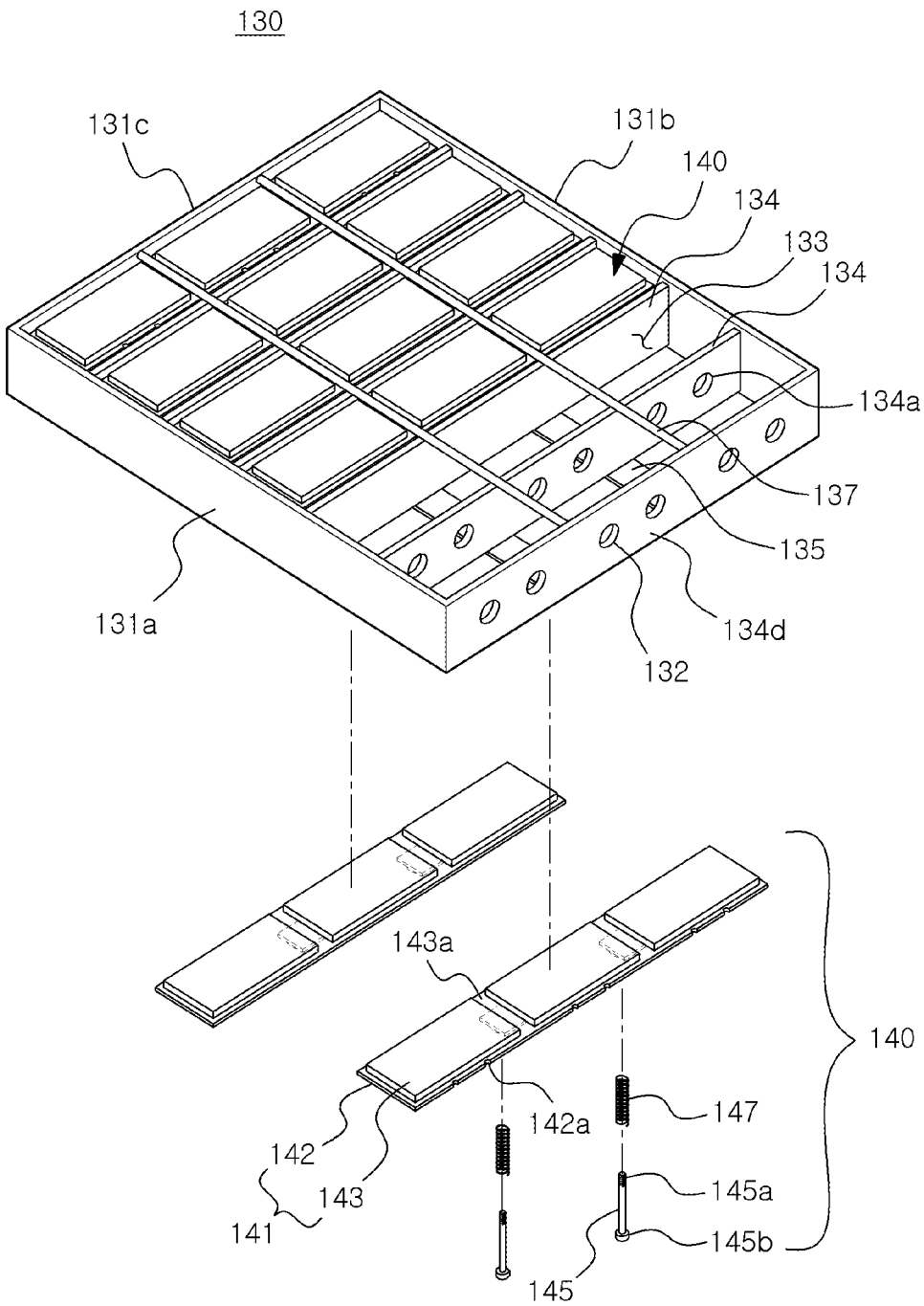
FIG. 2 is a perspective view showing an example of an ascending-descending module of the grating in FIG. 1.
Figure 3:
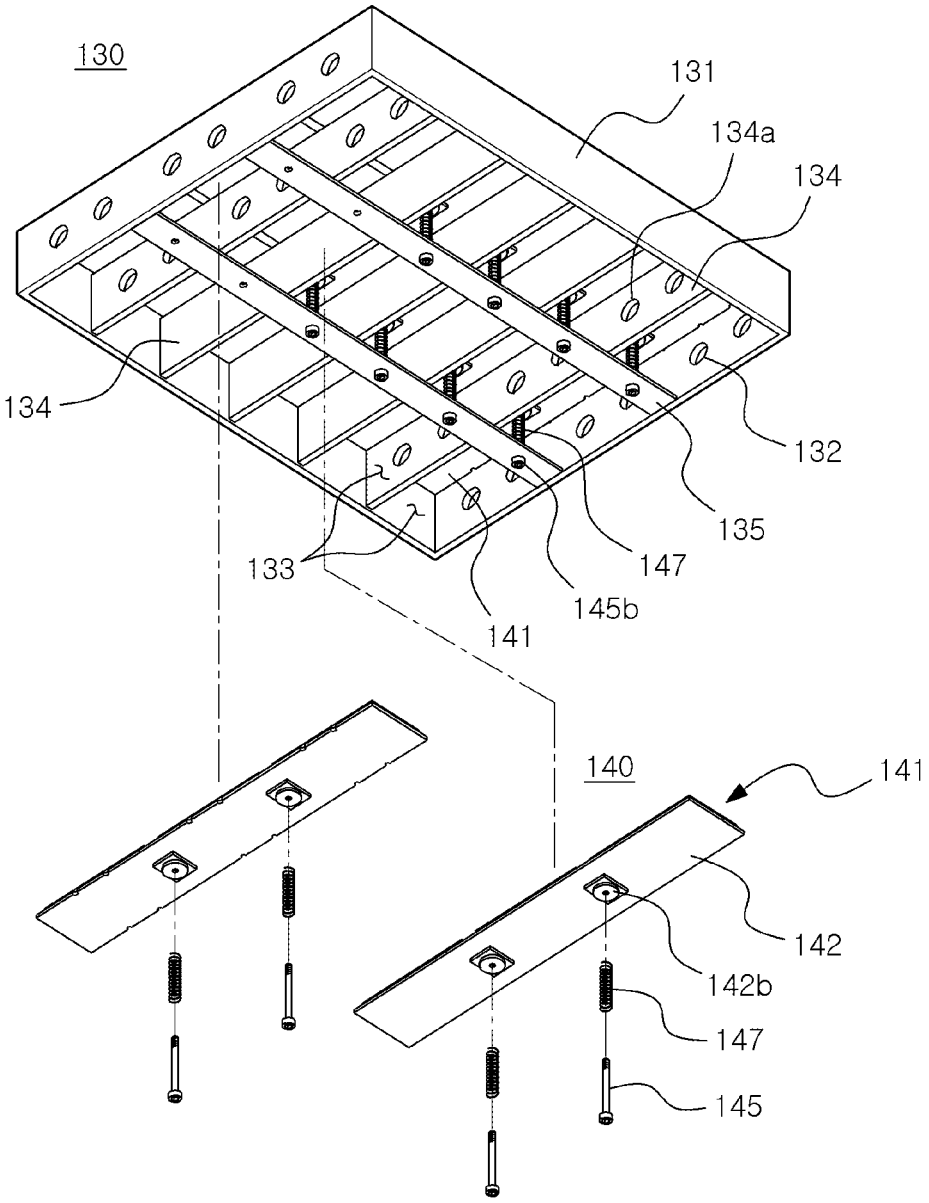
FIG. 3 is a bottom perspective view of FIG. 2.
Figure 4A:
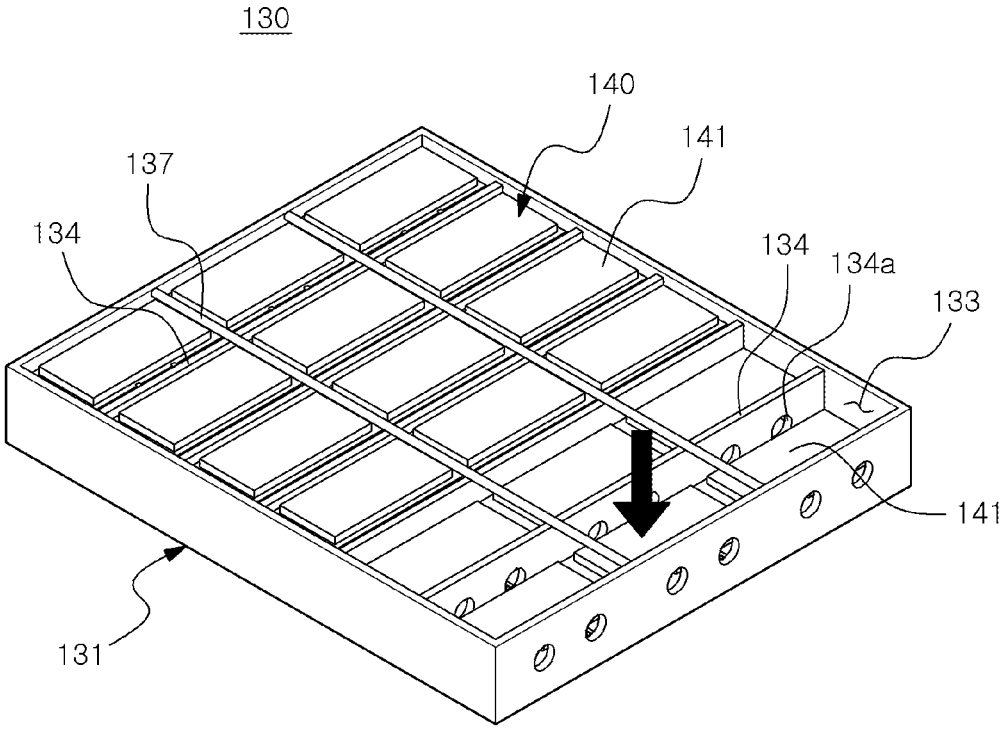
FIGS. 4A and 4B are a perspective view and a sectional view showing an example state in which moving panels are moved downward by a hydraulic pressure in the grating.
Figure 4B:
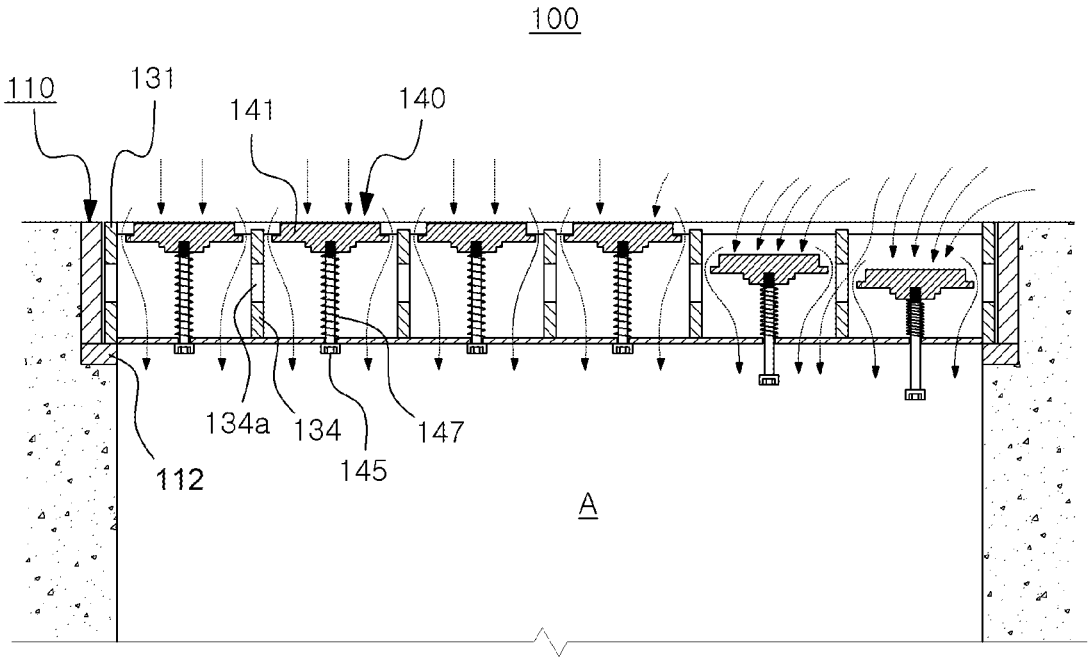
Figure 5:
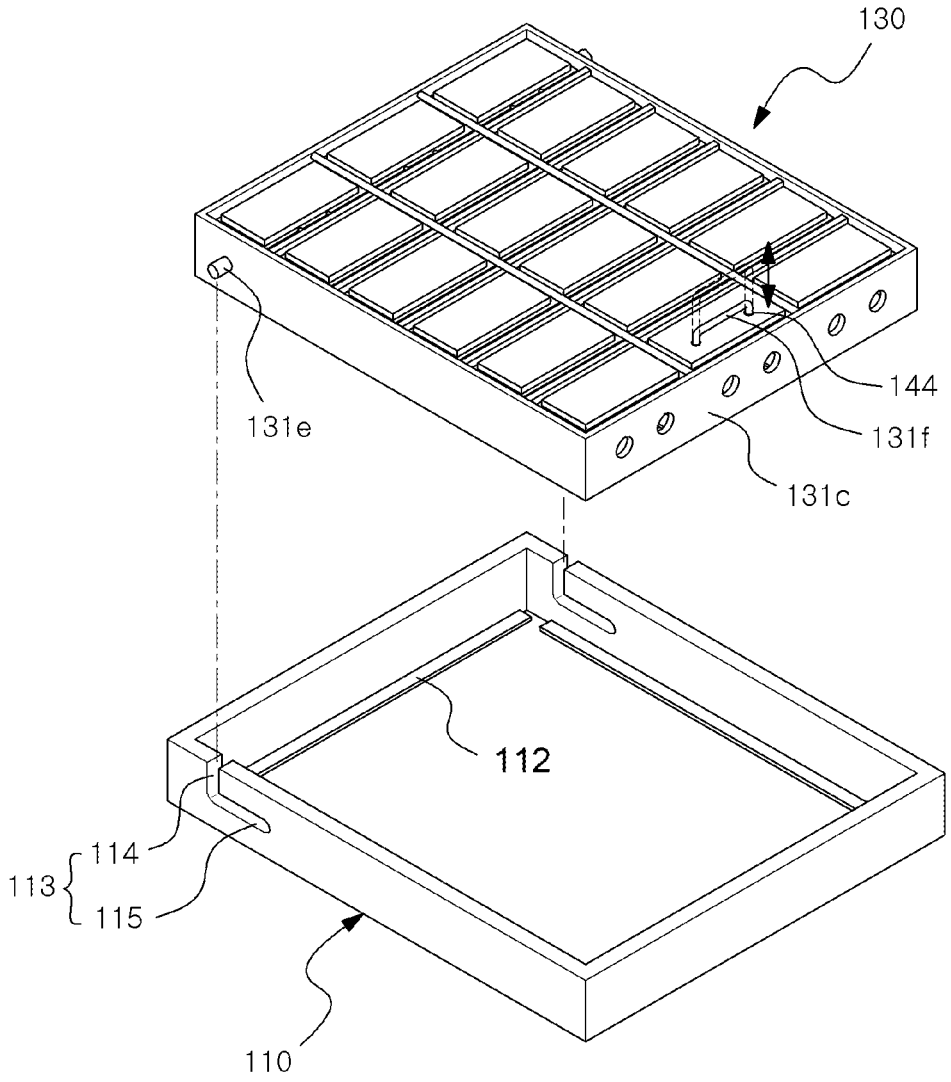
FIGS. 5 and 6 are an exploded perspective view and a sectional view showing examples of a grating and a frame.
Figure 6:
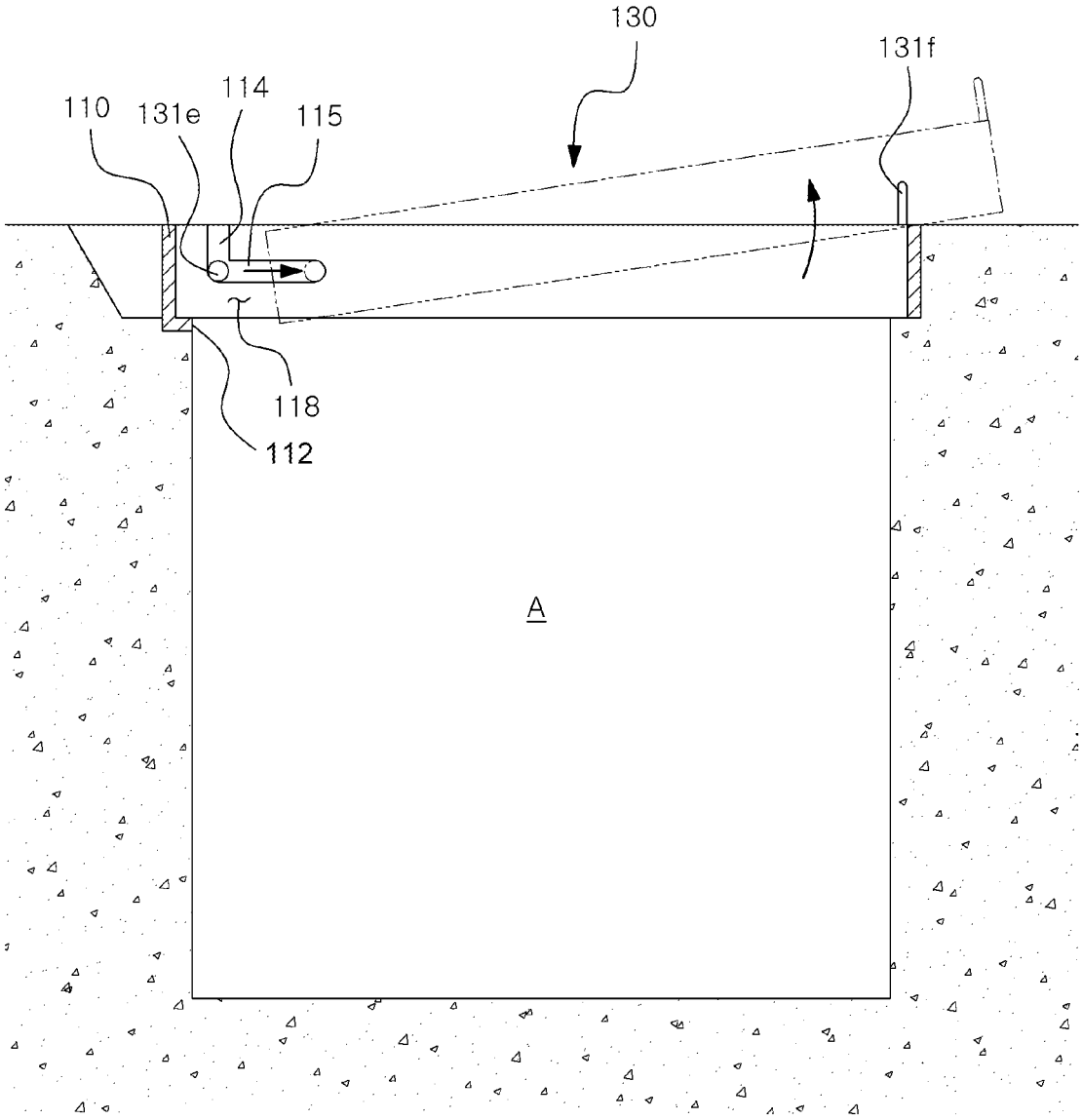
Figure 7A:
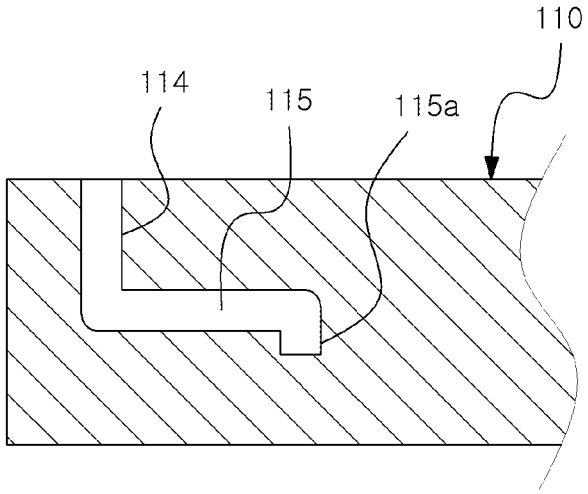
FIGS. 7A and 7B are views showing examples of a guide groove different from the structure of FIG. 6.
Figure 7B:
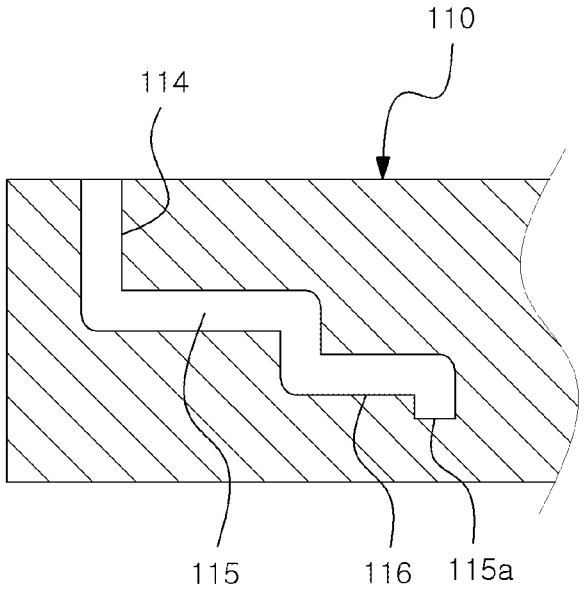
Figure 8A:
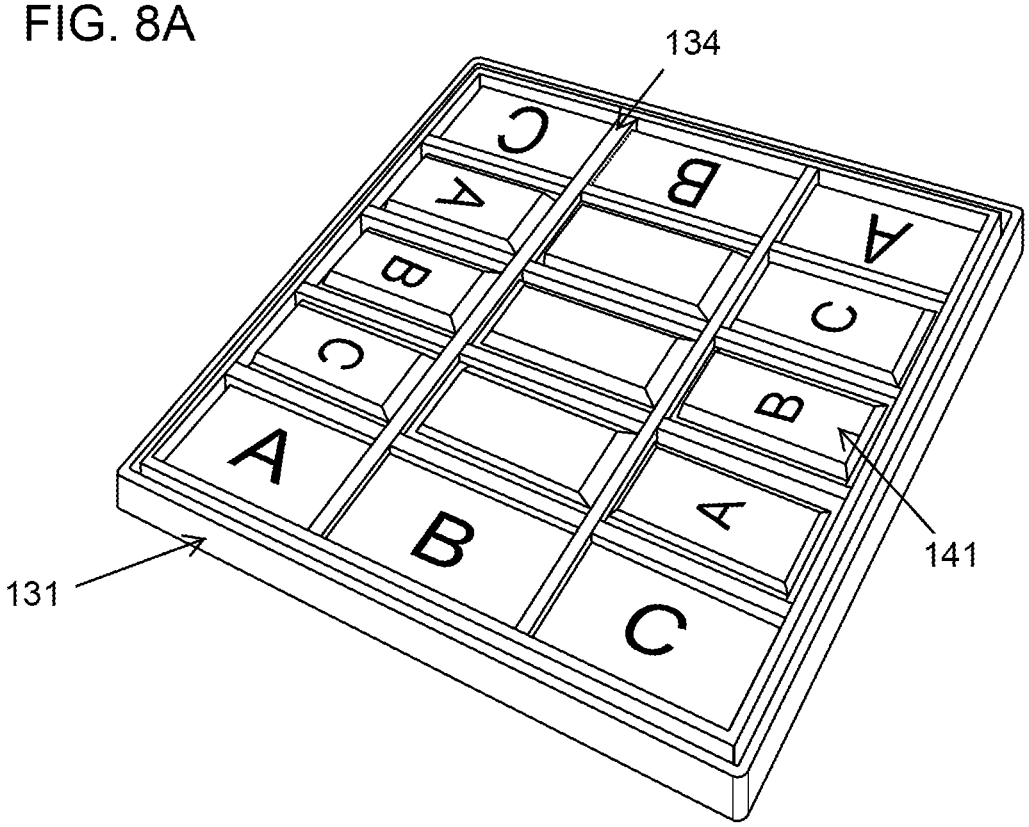
FIGS. 8A and 8B are views showing examples of a grating panels and a grating.
Figure 8B:
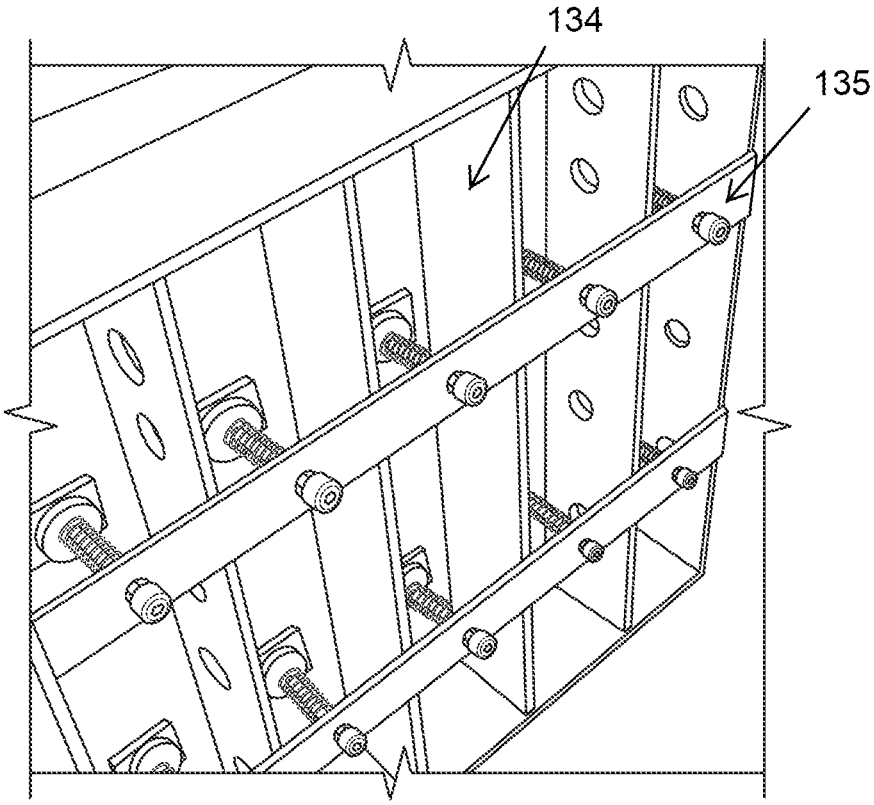
Figure 9:
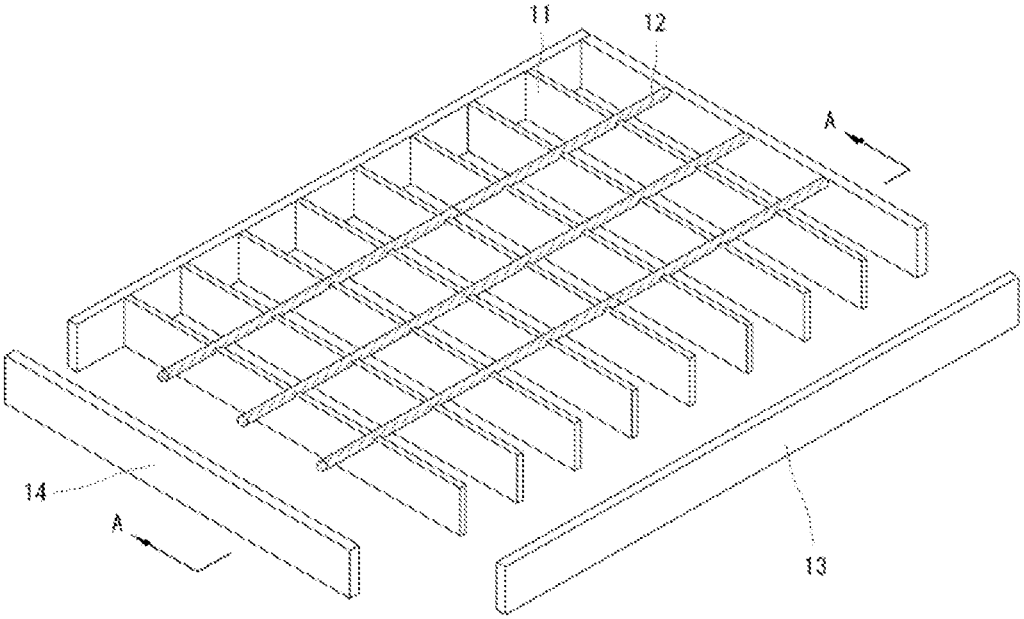
FIG. 9 is a perspective view showing an example of a grating.

FIG. 1 is a perspective view showing an example of a grating, FIG. 2 is a perspective view showing a part of an example of an ascending-descending module disassembled from the grating in FIG. 1, and FIG. 3 is a bottom perspective view of FIG. 2. FIGS. 4A and 4B are a perspective view and a sectional view showing an example state in which some of example moving panels are moved down by a hydraulic pressure in the grating, respectively. FIGS. 5 and 6 are an exploded perspective view and a sectional view showing examples of a grating structure, respectively. FIGS. 7A and 7B are views showing examples of a guide groove having a structure different from the structure of FIG. 6, and FIGS. 8A and 8B are views showing examples of a grating.

Referring to FIGS. 1 to 8B, a drainage grating structure 100 includes a support 110 that can be installed in a drain A (see FIG. 4B) provided in, for example, a road or a road surface, and a grating 130 that can be seated on the support 110 disposed at the drain.

The support 110 can have a rectangular shape or a square shape, and may be provided on an inner surface thereof with a seating protrusion 112 so that a rim of the grating may be seated.

In some implementations, the grating 130 can include: a frame 131 seated on a rim of the support 110; a plurality of vertical panels 134 having one end connected to a first surface 131*a* of the frame 131 and an opposite end connected to a second surface 131*b* facing the first surface 131*a* of the frame 131 to partition the frame 131, and having a panel drainage hole 134*a*; at least two lower support bars 135 disposed on a lower portion of the frame 131, having one end connected to a third surface 131*c* of the frame 131 and an opposite end connected to a fourth surface 131*d* facing the third surface 131*c* of the rectangular frame 131; an upper support bar 137 disposed on an upper portion of the rectangular frame 131, and perpendicular to the vertical panel 134; and a plurality of ascending-descending modules 140 including moving panels 141 installed in partition spaces of the frame 131 partitioned by the vertical panels 134, respectively. The frame 131 can have a rectangular shape or a square shape having four side surfaces.

For example, the rectangular frame 131 may include the first surface 131*a* and the second surface 131*b* provided on left and right sides of the rectangular frame 131 to face each other, and the third surface 131*c* and the fourth surface 131*d* provided on front and rear sides of the rectangular frame 131 to face each other, in which a frame drainage hole 132 may be formed in at least one of the first to fourth surfaces.

The vertical panel 134 may be fixed to the first surface 131*a* and the second surface 131*b* of the rectangular frame 131 through welding or the like. Similar to the rectangular frame 131, the frame drainage hole 132 may be formed in the vertical panel 134. Although the drainage hole has been shown in the drawings as having a circular shape, since the drainage hole has been shown for illustrative purposes only, the drainage hole may be configured as a long hole that is vertically elongated or may have an elliptical shape.

Both ends of the lower support bar 135 may be boned to the rectangular frame through the welding or the like, an area where the lower support bar 135 makes contact with the vertical panel 134 intersecting the lower support bar 135 may also be bonded, and a through-hole 136 may be formed at positions corresponding to partition spaces 133, respectively.

In some implementations, at least a pair of lower support bars 135 on the left and right sides are installed so that the moving panel 141 can be horizontally maintained without being inclined to either side thereof, and stably ascend and descend.

Similar to the lower support bar 135, the upper support bar 137 may be bonded to the rectangular frame 131 and an upper end of the vertical panel 134 through the welding or the like, and may form a lattice structure together with the vertical panel 134.

In some implementations, the ascending-descending module 140 may include: a moving panel 141 disposed on an upper portion of the partition space 133; a guide pin 145 having one end, which is a fixed end fixed to the moving panel 141, and an opposite end, which is a free end inserted into a through-hole 136 formed in the lower support bar 135 so as to be movable up and down; and a spring 147 fitted to the guide pin 145 to provide elasticity.

The moving panel 141 may include: a base part 142 including a rim having a drainage groove 142*a*, formed in a bottom surface thereof with a fixing hole 142*b* having a screw thread so as to be screw-coupled with the guide pin 145, and disposed on a lower portion of the upper support bar 137; a plurality of protruding surfaces 143 provided on a top surface of the base part 142; and a seating groove part 143*a* formed between adjacent protruding surfaces 143 so that the upper support bar 137 is seated on the seating groove part 143*a*.

In some implementations, the protruding surface 143 is provided for each lattice structure formed by the vertical panel 134 and the upper support bar 137, and the upper support bar 137 fitted in the seating groove part 143*a* and the protruding surface 143 have corresponding heights, so that a top surface of the grating may have a structure as flat as possible, and thus fallen leaves or various foreign substances may be easily removed with a broom or the like when the fallen leaves or foreign substances accumulate on the grating.

In addition, as shown in FIG. 8A, a name, a logo, a trademark, or the like of a private enterprise or the like as well as the government and a local autonomous entity that manage the grating may be written on the protruding surface to specify a management entity or provide advertisements or propagations. For example, the moving panel 141 has letters "A," "B," and "C" in FIG. 8A. In other examples, the moving panel 141 can have words, images, or the like.

In case of light rain, the moving panel 141 may not descend because a hydraulic pressure of introduced water may be weaker than the elasticity of the spring 147. In this case, however, a plurality of drainage grooves 142*a* are formed in a rim of the moving panel 141, so that drainage may be smoothly performed.

In addition, since an upper portion of the grating 130 is blocked by the moving panel 141, the foreign substances on the grating may be easily cleaned while the foreign substances are prevented from being introduced into the frame drainage holes 132 and panel drainage holes 134*a* as much as possible.

The guide pin 145 may be illustrated to have a bolt structure in which the guide pin 145 is formed at one end thereof with a screw thread 145*a* so as to be screw-coupled to the fixing hole 142*b* and provided at an opposite end thereof with a bolt head 145*b* having a diameter greater than a diameter of the through-hole 136. The guide pin may not fall out of the through-hole 136 due to the bolt head 145*b*.

The spring 147 may be fitted to the guide pin 145 so that an upper end of the spring 147 may make contact with the bottom surface of the moving panel 141 and a lower end of the spring 147 may make contact with the lower support bar 135, and may allow the moving panel 141 to descend only when the hydraulic pressure of the introduced water is greater than the elasticity of the spring 147. When the moving panel 141 descends, the drainage holes 132 and 134*a* may be exposed so that the drainage may be performed, and when the pressure of the water is released or reduced, the moving panel 141 may ascend due to the elasticity of the spring 147 so that the drainage holes 132 and 134*a* may not be exposed to an outside.

FIGS. 5 to 7B illustrate an example of a coupling structure capable of partially removing the grating 130 seated on the support 110. The above configuration may help drainage in cases where pouring water may not be sufficiently drained with the ascending-descending module, for example, in a rainy season or in case of localized heavy rain. In some examples, the grating 130 can be completely removed from the support 110. In some examples, the grating 130 can be partially moved relative to the support 110 and supported on a ground surface as shown in FIG. 6.

In some implementations, guide grooves 113 may be formed in front ends of both side surfaces of the support 110 facing each other, respectively.

The guide groove 113 can include a fitting groove 114 having an opened upper portion and vertically extending to a lower side, and a movement groove 115 extending from a lower end of the fitting groove 114 to one side.

The first and second surfaces 131*a* and 131*b* of the rectangular frame 131 may be provided with fitting pieces 131*e* fitted into the guide grooves 113, respectively. The fitting pieces 131*e* can include fitting protrusions that protrude outward from the first and second surfaces 131*a* and 131*b* of the frame 131.

For example, when a large amount of water is introduced due to the localized heavy rain, smooth drainage may not be achieved with only the drainage hole exposed as the moving panel 141 descends. Therefore, in this case, when a handle 131*f* provided on one side of the grating 130 is lifted and pulled to one side such that only a part of the grating 130 may be placed on the support 110, the grating 130 may be placed in an inclined state, a large separation space 118 through which a large amount of water may be introduced may be formed between the support 110 and a front end of and the grating 130, and a large amount of water may be drained through the separation space 118. In this case, the fitting groove 114 is configured such that the fitting piece 131*e* may be fitted to and assembled with the fitting groove 114, while the movement groove 115 may serve to provide a space to allow the fitting piece 131*e* to move and to guide the fitting piece 131*e* when the grating 130 is pulled to one side.

In this case, the handle 131*f* may be illustrated as being inserted into a fitting hole 144 formed in the moving panel 141 so as to be movable up and down as shown in FIG. 5, and as being installed on the rectangular frame 131 as shown in FIG. 6.

The movement groove 115 may be horizontally formed as shown in FIG. 6, and may be formed at an end thereof with a fitting piece fixing groove 115*a* for accommodating the fitting piece 131*e* so that one side of the grating 130 may be stably fixed while being placed on the support 220 in the inclined state as shown in FIG. 7A. In addition, as shown in FIG. 7B, the movement groove 115 may have a structure in which a plurality of latching sills 116 are formed in a stepped manner. In this case, a movement distance of the grating 130 may be freely set to correspond to each of the latching sills 116.

The present disclosure has been described above for illustrative purposes only, and a person having ordinary skill in the art to which the present disclosure pertains will appreciate that various modifications and other equivalent embodiments can be made from the above embodiments. Therefore, it will be understood that the present disclosure is not limited to the configuration mentioned in the detailed description of the disclosure. Accordingly, the technical protection scope should be determined by the technical idea of the appended claims. In addition, it will be understood that the present disclosure encompasses the spirit as defined by the appended claims, and all modifications, equivalents, and substitutes within the scope.

What is claimed is:

1. A drainage grating configured to be installed on a drain, the drainage grating comprising:

a frame configured to be disposed at a rim of the drain, the frame having a first surface, a second surface facing the first surface, a third surface connected to the second surface, and a fourth surface facing the third surface, a plurality of vertical panels that are arranged inside the frame and partition an inside of the frame into a plurality of partition spaces, each vertical panel having a first end connected to the first surface of the frame and a second end connected to the second surface of the frame, a plurality of lower support bars that are disposed at a lower portion of the frame and extend in a direction across the plurality of vertical panels, each lower support bar having a first end connected to the third surface of the frame and a second end connected to the fourth surface of the frame, an upper support bar that is disposed at an upper portion of the frame and extends perpendicular to the plurality of vertical panels, and a plurality of moving panels that are disposed at upper portions of the plurality of partition spaces, respectively, each moving panel being configured to, based on water pressure applied thereon, move within one of the plurality of partition spaces relative to the plurality of vertical panels.

2. The drainage grating of claim 1, further comprising:

a plurality of guide pins configured to move up and down relative to the lower support bars, each guide pin having a fixed end coupled to one of the moving panels, and a free end configured to move up and down through one of the lower support bars; and a plurality of springs disposed at the plurality of guide pins, respectively, each spring being configured to supply elastic force to one of the moving panels and one of the lower support bars.

3. The drainage grating of claim 2, wherein the plurality of vertical panels define a panel drainage hole, and wherein each of the moving panels is configured to:

based on an increase of the water pressure applied to a moving panel among the plurality of moving panels, move downward relative to the vertical panels such that water is drained through the panel drainage hole; and based on a decrease of the water pressure applied to the moving panel, move upward by the elastic force of one of the springs disposed at the moving panel.

4. The drainage grating of claim 3, wherein the lower support bars define a through-hole configured to receive one of the plurality of guide pins.

5. The drainage grating of claim 3, wherein each of the lower support bars defines a plurality of through-holes, each through-hole being configured to receive one of the plurality of guide pins based on the one of the plurality of guide pins moving downward.

6. The drainage grating of claim 2, wherein each of the moving panels comprises:

a base that defines a rim of one of the moving panels, the base having a bottom surface that defines a fixing hole screw-coupled with one of the guide pins; and a plurality of protruding surfaces that protrude from a top surface of the base and that are spaced apart from one another.

7. The drainage grating of claim 6, wherein the plurality of protruding surfaces define a seating groove between adjacent protruding surfaces of the plurality of protruding surface, the seating groove supporting the upper support bar.

8. The drainage grating of claim 6, wherein the base defines a drainage groove at the rim of the one of the moving panels.

9. The drainage grating of claim 1, wherein the drainage grating is configured to be installed at a support that is disposed in the drain and that has side surfaces defining a pair of guide grooves, respectively, and wherein the frame comprises a pair of fitting protrusions that protrude outward relative to the first surface of the frame and the second surface of the frame, respectively, each fitting protrusion being configured to be inserted into one of the pair of guide grooves.

10. The drainage grating of claim 9, wherein each of the guide grooves comprises:

a fitting groove that extends downward from an upper surface of the support; and a movement groove that extends laterally from a lower end of the fitting groove toward the third surface or the fourth surface.

11. The drainage grating of claim 10, wherein the drainage grating is configured to rotate and translate relative to the support based on each of the fitting protrusions being inserted into and moving along the fitting groove and the movement groove.

12. The drainage grating of claim 1, wherein each of the moving panels defines a seating groove recessed from an upper surface of the moving panels and configured to support the upper support bar.

13. The drainage grating of claim 3, wherein the panel drainage hole is in communication with the plurality of partition spaces.

14. The drainage grating of claim 1, wherein each of the plurality of panels is configured to move between a first position in contact with the upper support bar and a second position vertically below the first position, the second position varying based on the water pressure applied to one of the plurality of moving panels.

15. The drainage grating of claim 1, wherein one or more of the plurality of vertical panels define a plurality of panel drainage holes spaced apart from one another along one of the plurality of vertical panels.

16. The drainage grating of claim 15, wherein the frame defines a plurality of frame drainage holes at the third surface of the frame and the fourth surface of the frame, and wherein each of the plurality of frame drainage holes faces one of the plurality of panel drainage holes.

17. The drainage grating of claim 1, wherein the plurality of vertical panels comprise:

a pair of outer vertical panels that face the third surface of the frame and the fourth surface of the frame, respective, each outer vertical plane defining a plurality of panel drainage holes; and a plurality of inner vertical panels disposed between the pair of outer vertical panels, and wherein the frame defines a plurality of frame drainage holes at the third surface of the frame and the fourth surface of the frame, and wherein each of the plurality of frame drainage holes faces one of the plurality of panel drainage holes.

18. A drainage grating configured to be installed at a drain, the drainage grating comprising:

a frame configured to be disposed at a rim of the drain, the frame having a first surface, a second surface facing the first surface, a third surface connected to the second surface, and a fourth surface facing the third surface;

a vertical panel that is disposed inside the frame and extends from the first surface of the frame to the second surface of the frame, the vertical panel partitioning an inside of the frame into a plurality of partition spaces;

a lower support bar that is disposed at a lower portion of the frame and extends across the vertical panel from the third surface of the frame to the fourth surface of the frame;

an upper support bar disposed at an upper portion of the frame and disposed perpendicular to the vertical panel; and a moving panel disposed in at least one of the plurality of partition spaces and disposed between the upper support bar and the lower support bar, the moving panel being configured to move between the upper support bar and the lower support bar based on water pressure applied to the moving panel.

19. The drainage grating of claim 18, further comprising:

a guide pin that extends from a bottom surface of the moving panel to the lower support bar, the guide pin having an upper end coupled to the bottom surface of the moving panel, and a lower end configured to pass through the lower support bar; and a spring that surrounds the guide pin and is configured to apply elastic force to the bottom surface of the moving panel and the lower support bar.

20. The drainage grating of claim 18, wherein at least one of the vertical panel, the third surface of the frame, or the fourth surface of the frame defines a drainage hole that is configured to discharge water to the drain based on movement of the moving panel toward the lower support bar.

* * * * *